US006107556A

United States Patent [19]

Gilliam

[11] Patent Number: 6,107,556

[45] Date of Patent: Aug. 22, 2000

[54] APPARATUS FOR TUNING OR INSTALLING STRINGS ON A MUSICAL INSTRUMENT

[76] Inventor: Michael Gilliam, 10350 Regis Ct., Rancho Cucamonga, Calif. 91730

[21] Appl. No.: 09/247,703

[22] Filed: Feb. 10, 1999

[51] Int. Cl.[7] ..... G10G 7/02

[52] U.S. Cl. ..... 84/454; 84/453; 84/455

[58] Field of Search ..... 84/453, 454, 455

[56] References Cited

U.S. PATENT DOCUMENTS

| | | | |
|---|---|---|---|
| 881,269 | 3/1908 | Van Houten | 84/454 |
| 2,702,937 | 3/1955 | Smart | 72/40 |
| 2,746,513 | 5/1956 | Kiesow et al. | 72/164 |
| 3,392,621 | 7/1968 | Pease | 84/454 |
| 3,405,590 | 10/1968 | Pease | 84/458 |
| 3,971,287 | 7/1976 | Ito | 84/453 |
| 4,112,808 | 9/1978 | Ketterer | 84/453 |
| 4,183,279 | 1/1980 | Shabram, Jr. | 84/318 |
| 4,197,780 | 4/1980 | Smith | 84/458 |

*Primary Examiner*—Paul Ip
*Assistant Examiner*—Shih-yung Hsieh
*Attorney, Agent, or Firm*—Knobbe, Martens, Olson & Bear, LLP

[57] ABSTRACT

The present invention relates to a hand-held device for tensioning and stabilizing the strings of a stringed musical instrument, such as a guitar, during tuning or installation of the strings. In one embodiment, the device comprises a structure having a pair of arms that define a substantially forked or "V" shape. In use, the device is positioned against the neck of the guitar and a string is threaded between a pair of spools on at least one of the arms of the device. The device is then pivoted about an apex to lift the string away from the guitar neck and apply tension thereto during tuning or installation of the string. The device allows for easy tensioning of the string during the tuning or installation process.

13 Claims, 6 Drawing Sheets

APPARATUS FOR TUNING OR INSTALLING STRINGS ON A MUSICAL INSTRUMENT

BACKGROUND OF THE INVENTION

The present invention relates to stringed musical instruments. In particular, the present invention relates to an apparatus for easily installing and tensioning the strings of a musical instrument, such as a guitar, during the installation and tuning process.

Stringed musical instruments produce sound through the vibration of a string or a group of strings that are mounted in tension to the musical instrument. The pitch of the sound is generally a function of the length of the string and level of tension in the string, which is set when a string is initially attached to the instrument. During installation of the string, a user tunes the instrument by slowly tightening the string to vary the tension until an undamped string produces a desired pitch.

Acoustic guitars have several strings that extend in tension from the bridge of the guitar to the head of the guitar. Replacing a string comprises attaching one end of each string to the guitar bridge and the other end of the string to a respective tuning peg in the guitar head. The peg is then rotated so that the string wraps around the tuning peg. In this manner, slack is removed from the string and tension is applied thereto. The pitch of the string is adjusted and the instrument is tuned by slowly turning the peg and varying the amount of tension in the strings.

The tuning of each string is greatly improved if the user applies steady tension to the string, which results in a uniform string windage as the string winds around the tuning peg. The string tends to be arranged in more uniform coils when wound under constant tension, and the tension within the string is generally balanced at all times during the winding. The steady string tension reduces the likelihood that a portion of the string already wound on the peg will shift or slip as it adjusts to slight fluctuations in tension imposed during winding.

Unfortunately, it is very difficult for a user to apply tension to the string using his or her hands, as the tension causes the string to dig into the hands. This can be quite painful, especially for the high levels of tension that are desired. Consequently, the user often applies an uneven tension as the string is wound around the peg, which degrades the tuning of the instrument.

Another problem arises after the strings have been fully tightened. The strings often retain a slight spiral shape as a result of prolonged periods on storage spools. After the strings have been installed on the instrument, the spirals gradually straighten over time so that the string exhibits slack, which degrades the tuning of the guitar. Even strings without any spiral shape often tend to become slack as they adjust to the tension applied to them and stretch over time. As this happens, the string requires further winding in order to return it to the proper tension. This process must often be repeated several times, until an equilibrium point is reached where no more stretching occurs at the required tension level in the string. Until such time as the tension has stabilized, normal use of the instrument tends to pull the string out of tune due to this stretching, which is accelerated by use.

This process of use and repeated re-tuning over time in order to break in a string is not always practical for a musician. Sometimes it is necessary for a single string to be replaced and broken in as soon as possible without upsetting the remaining strings on the instrument. For instance, if a string breaks during a performance, a musician cannot periodically stop and re-tune the instrument as the string relaxes and falls out of tune. Furthermore, new strings often have more desirable sound qualities than strings which have already been in use for the time needed to break in a string.

Therefore, there is a need for a device which provides for smooth application of tension during the winding of the string onto a musical instrument, without pulling the string out of alignment from the tuning peg. Desirably, the device can also be used to break in and stabilize the tension of a string after initial tuning.

SUMMARY OF THE INVENTION

The aforementioned needs are satisfied by the present invention which relates to a hand-held device for tensioning and stabilizing the strings of a musical instrument, such as a guitar, during installation or tuning of the strings. In one embodiment, the device comprises a planar structure having a pair of arms that define a substantially forked or "V" shape. A handle or flange is preferably disposed on the end of the second arms for allowing a user to grab the device. A pair of string guides, such as spools, are disposed on the second arm. The guides are positioned such that a guitar string may be threaded therebetween. Preferably, the string guides are vertically offset so that the string follows a diagonal path therebetween.

In operation, the apparatus is placed with the first arm positioned flatly on the neck of the guitar. The guitar string that is to be tensioned is then threaded between the two spools. The apparatus is then pivoted so that the first arm extends upwardly from the guitar neck, pulling on the string such that the device exerts tension in the string. This may be accomplished by using the thumb of one hand to move the handle toward the neck of the guitar or other instrument. In this manner, the user can easily apply various amounts of tension to the string as the tuning pegs are rotated and the slack in the strings is gradually removed. As additional string is wound onto a tuning peg, pressure on the handle may be relaxed, allowing the second arm to gradually return to a flat position against the neck of the guitar.

Advantageously, the present invention allows for constant pressure to be applied to the string as it is wound onto the tuning peg. This allows for the most beneficial windage of the excess string onto the tuning peg. Furthermore, the device will tension the string without the string departing significantly from the correct angle at which it meets the head of the guitar and the tuning peg.

A further advantage of applying tension without pulling the string out of alignment with the tuning peg is that this also minimizes the off axis forces which are applied to the neck of the instrument. Because the neck of an instrument is generally designed to support loads along the long axis of the neck, rather than loads transverse to the direction of the neck, it is advantageous to apply any additional force by pulling the string in the direction in which it ordinarily lies. Because the string remains close to its ordinary position throughout the tensioning process, less force is applied away from the axis of the neck compared to systems which pull the strings away from the neck of the device. This avoids unusual stress to the neck of the instrument, preventing possible damage.

In further operation, the device is positioned with the second arm flat against the neck of the guitar. The device is then moved along the length of the string, from the bridge of the instrument to the nut and back without removing the string from the string guides. The string is thereby worked to remove excess winding. By performing this motion, repeated small transverse forces are applied along the length of the string. The repeated forces introduced into the string produce a cold working effect upon the string. This effect produces a relaxation of the string which would ordinarily take significantly longer to appear. The string may then be re-tensioned immediately, without having to wait for an extended period of use before any slack appears. The diagonal path that the string follows between the string guides will tend to remove any remnants of the spiral shape that was incurred during storage.

Once sufficient slack is removed by such "rolling" of the string between the string guides, the string is re-tensioned and any extra slack in the string is then removed by turning the tuning peg. The string has now been stabilized at the correct tension without having to endure a long breaking-in process.

The apparatus of the present invention allows for easy installation or tuning of strings on a musical instrument. Advantageously, the apparatus allows a user to apply a steady tension to the string during such installation. The apparatus also allows a user to cold work the string after installation to reduce the amount of time that it takes to break in a new string after installation.

BRIEF DESCRIPTION OF THE DRAWINGS

These and other features of the invention will now be described with reference to the drawings of a preferred embodiment, which are intended to illustrate and not to limit the invention, and in which.

DETAILED DESCRIPTION OF THE PREFERRED EMBODIMENT

Figure 1:
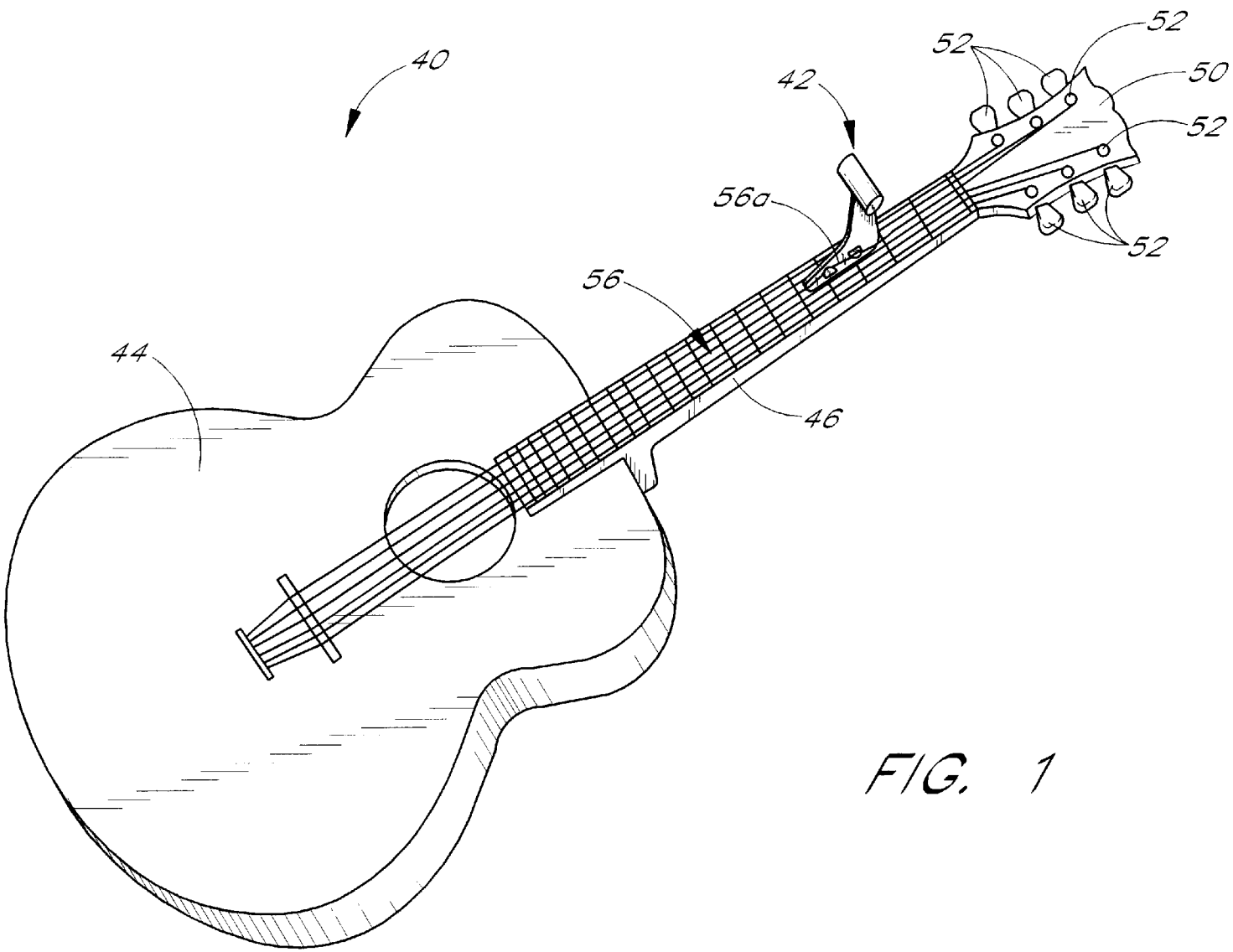
FIG. 1 is a perspective view of the tuning apparatus of the present invention in use upon a guitar.

FIG. 1 is a perspective view of an acoustic guitar 40 and a hand-held tuning and tensioning apparatus 42 in use thereon. The tensioning apparatus 42 is used to easily apply a constant tension to the guitar strings during tuning of the guitar, as described in more detail below. The tensioning apparatus 42 may also used to condition the strings after installation on the guitar 40. Although the tensioning apparatus 42 is described herein with reference to use with a guitar, it will be appreciated that the tensioning apparatus 42 may be used to apply tension to the strings of any of a wide variety of similarly stringed musical instruments, such as violins, cellos, etc.

With reference to FIG. 1, the guitar 40 generally comprises a main body 44 and a neck 46 having a first end connected to the main body 44 and a second end upon which a head 50 is disposed, as will be known to those skilled in the art. A plurality of tuning pegs 52 are removably mounted to the head 50 in a well known manner. A plurality of strings 56 extend in tension from the tuning pegs 52 to a bridge 54 that is disposed on the main body 44. As shown in FIG. 1, the tensioning apparatus 42 may be positioned on the neck 46 with a single string 56*a* laced through a set of spools on the apparatus 42 during the stringing and tuning of the guitar.

Figure 2:
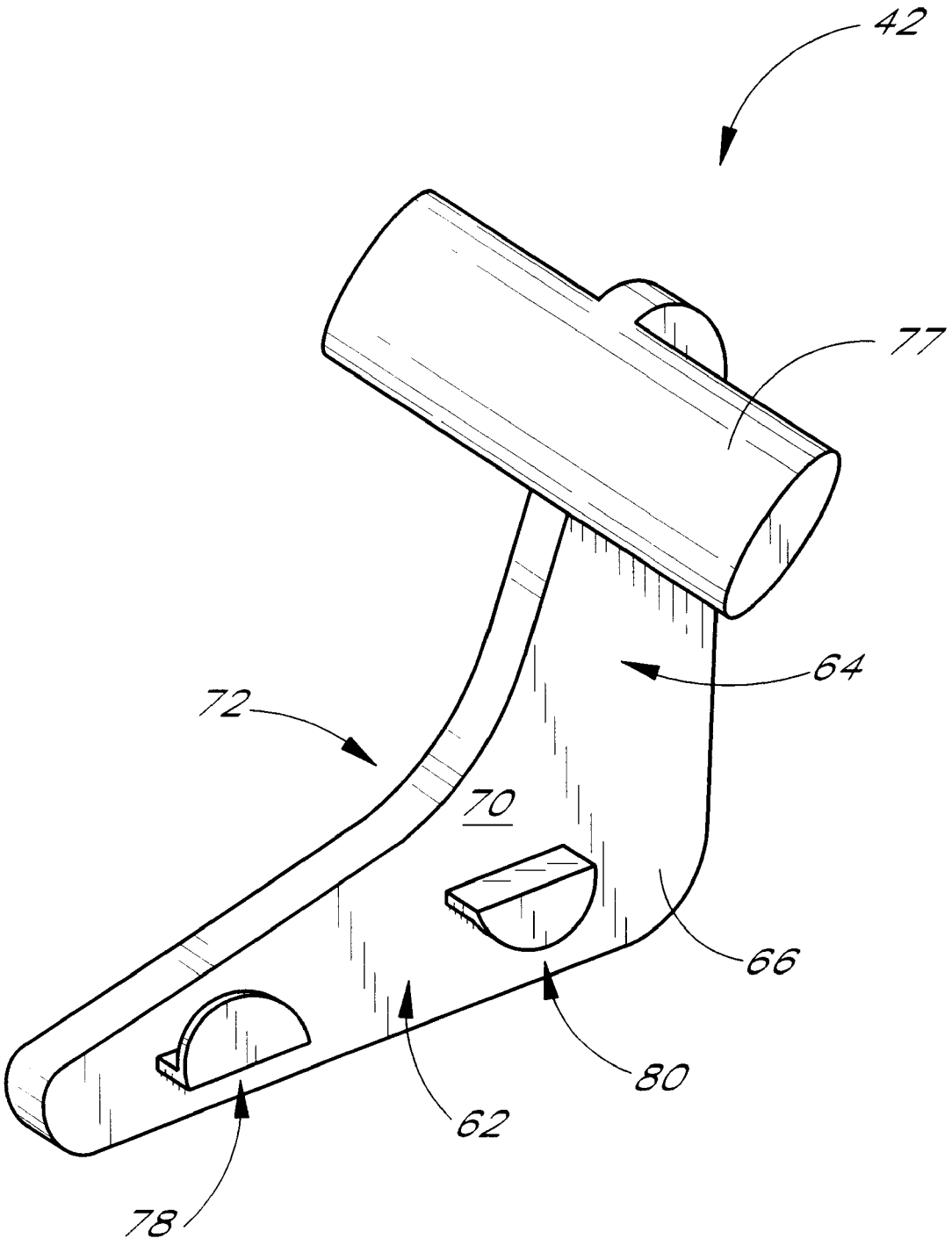
FIG. 2 is a perspective view of the tuning apparatus of the present invention.
Figure 3:
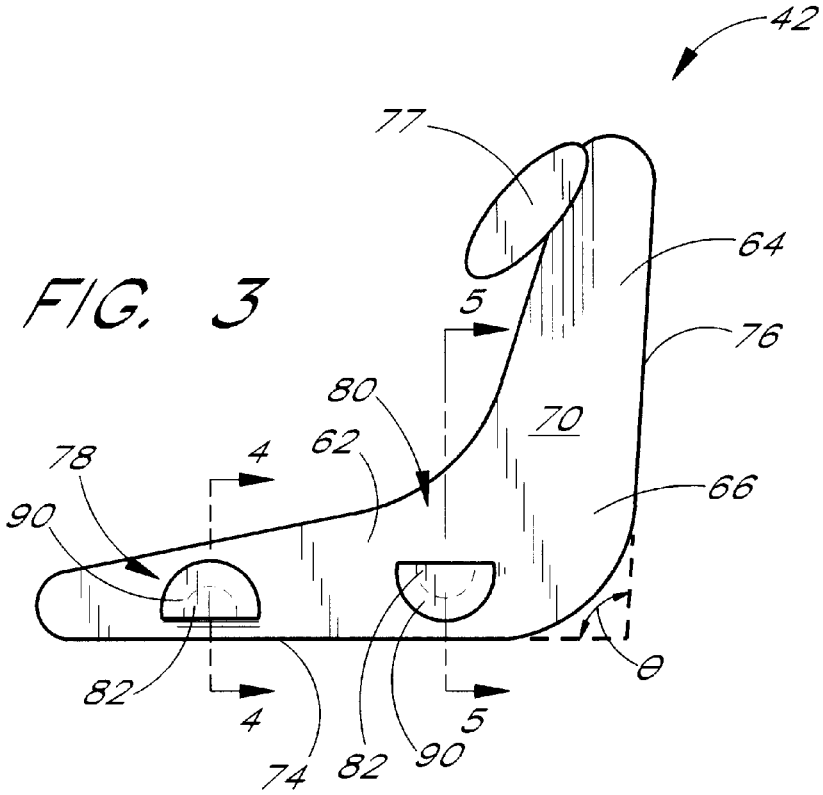
FIG. 3 is a side view of the tuning apparatus.

With reference to FIGS. 2 and 3, the tensioning apparatus 42 generally comprises a substantially flat structure that forms a first arm 62 and a second arm 64. In the illustrated embodiment, the first arm 62 and the second arm 64 are connected at an apex or junction 66 so that the structure generally defines a v-shape. The tensioning apparatus 42 defines a first side surface 70 and a second side surface 72 opposed thereto such that the structure has a thickness T, defined as the distance between the first and second side surfaces 70 and 72, respectively. The outer peripheral edge of the first arm 62 preferably forms a substantially flat bottom surface 74. The peripheral edges of the outer second arm form a substantially flat rear surface 76 of the tensioning apparatus 42.

With reference to FIGS. 2–3, a handle 77 is disposed on the tensioning apparatus 42. The handle 77 is preferably disposed at a location that may be easily grasped by a user, such as near the end of the second arm 64 distal of the junction 66. The tensioning apparatus 42 is preferably equipped with a handle 77 in order to facilitate ease of operation of the tuning device 42, although it will be appreciated that the tensioning apparatus 42 could also be operated without a handle. The location and shape of the handle 77 may be varied to suit various users.

As best shown in FIG. 3, the bottom surface 74 and rear surface 76 define a pair of planes that form an angle $\theta$ therebetween. In the illustrated embodiment, the angle $\theta$ is approximately 90 degrees. The angle $\theta$ preferably is in the approximate range of 70 degrees to 110 degrees.

The tensioning apparatus 42 is preferably sized to be held within one hand of a user. Toward this end, the thickness T of the tensioning apparatus 42 is preferably in the range of approximately 0.2 inches to 0.5 inches. In one embodiment, the thickness T is approximately 0.3 inches. The first arm 62 and the second arm 64 are preferably each approximately 2 inches to 6 inches in length. The length of the first arm 62 is not necessarily equal to the length of the second arm 64. The aforementioned directions are advantageous in that they provide a size that may be easily held within the hand of an average user. However, the dimensions of the apparatus 42 may be varied widely for various materials used to manufacture the apparatus 42 and to suit the apparatus for a particular type of instrument.

Figure 4:
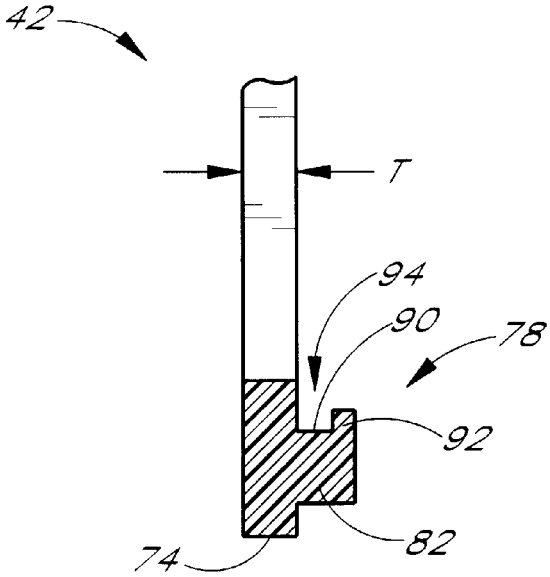
FIG. 4 is a cross-sectional view of the tuning apparatus along line 4—4 of FIG. 3.
Figure 5:
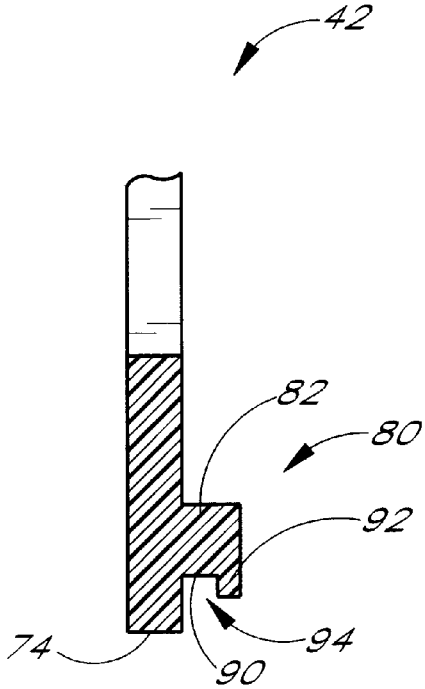
FIG. 5 is a cross-sectional view of the tuning apparatus along line 5—5 of FIG. 3.

With reference to FIGS. 2 and 3, at least two string guides 78, 80 are disposed on at least one of the side surface 70 or 72 of the tensioning apparatus 42. In the illustrated embodiment, the string guides 78, 80 are disposed on the first side surface 70, although the string guides may be disposed on either the first or second side surface 70, 72, or on both surfaces. The string guides 78, 80 are each configured to receive thereon or thereover a string 56 of the guitar so that the string guides 78, 80 serve to guide the string 56 over a desired path.

reference to FIGS. 3–5, in a preferred embodiment, each of the string guides 78, 80 comprises a spool 82 that extends outwardly from the side surface 72 of the tensioning apparatus 42. Each spool 82 defines a string support surface 90 that preferably has a convex contour. A flange or lip 92 is preferably disposed at a distal end of the spool 82 with respect to the second side surface 72. As best shown in FIGS. 4 and 5, a channel 94 is thereby formed between the lip 92 and the side surface 72. The channel 94 is dimensioned to receive at least one of the strings 56 therein. The string guides 78, 80 are preferably equipped with the lips 92 to reduce the likelihood of the string 56 inadvertently sliding off of the spool 82 during use, although the lips 92 are not necessary. Additionally, a fixed spool 82 is preferred for a simple design, although the string guides 78, 80 could also comprise rotatable devices, such as rollers, for facilitating movement of the strings 56 thereover.

Figure 6:
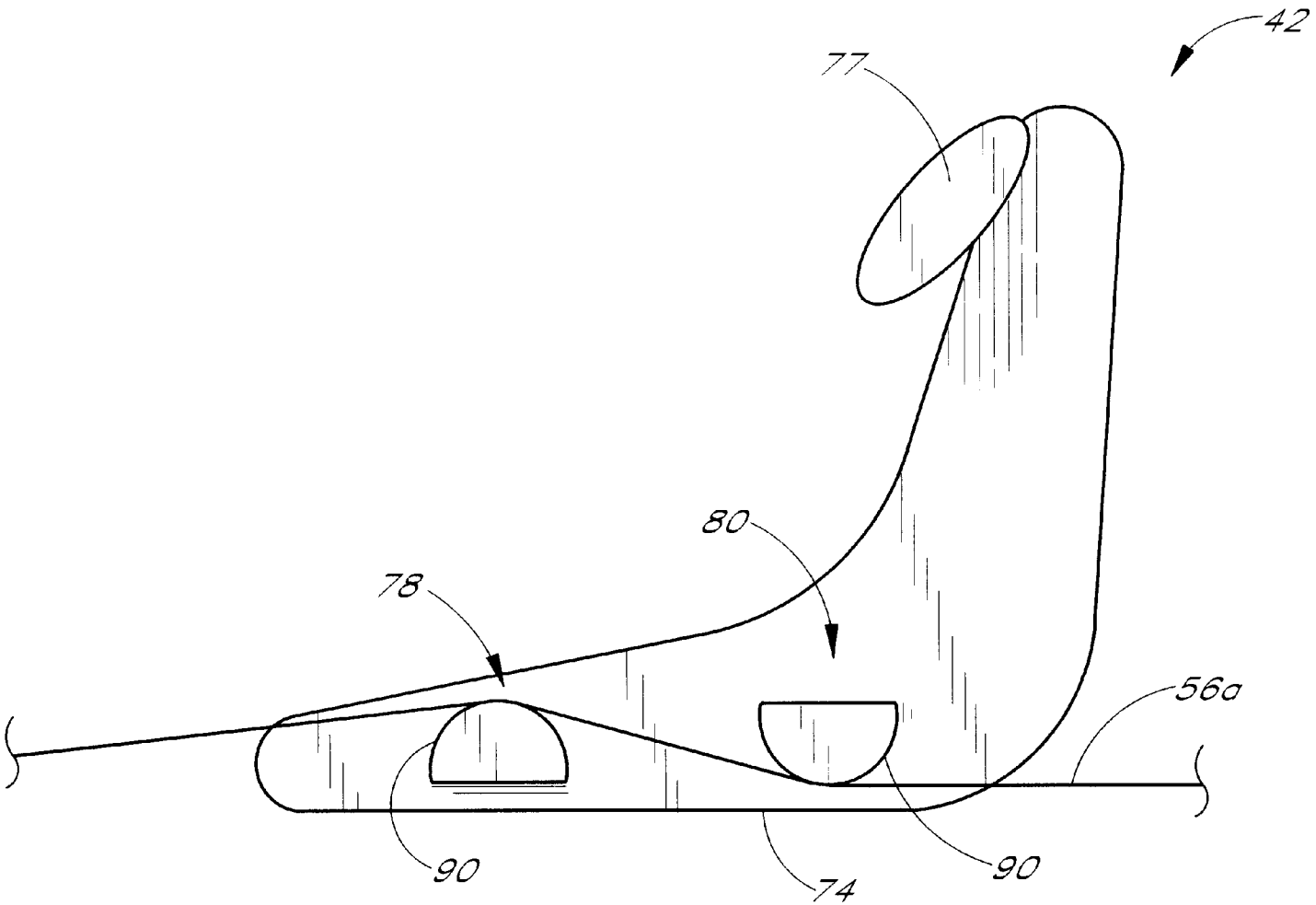
FIG. 6 is a side view of the tuning apparatus with a string threaded therethrough.

FIG. 6 is a side view of the tensioning apparatus 42 with a string 56*a* threaded through the string guides 78, 80. For ease of illustration, the string guides 78, 80 are shown without the lips 92. In a preferred embodiment, the string support surface 90 of the first string guide 78 faces upwardly or away from the bottom surface 74 of the tensioning apparatus 42. The string support surface 90 of the second string guide 80 preferably faces downwardly or toward the bottom surface 76 of the tensioning apparatus 42. The string 56*a* is threaded over the string guides 78, 80 so that the string 56*a* abuts the string support surfaces 90 of each of the string guides. Desirably, the string support surfaces 90 are vertically offset with respect to one another such that the string 56 bends along its length and thereby follows a diagonal path between the string guides 78, 80. In the illustrated embodiment, this is achieved by the string guide 78 being positioned a greater distance from the bottom surface 74 than the string guide 80.

Figure 7:
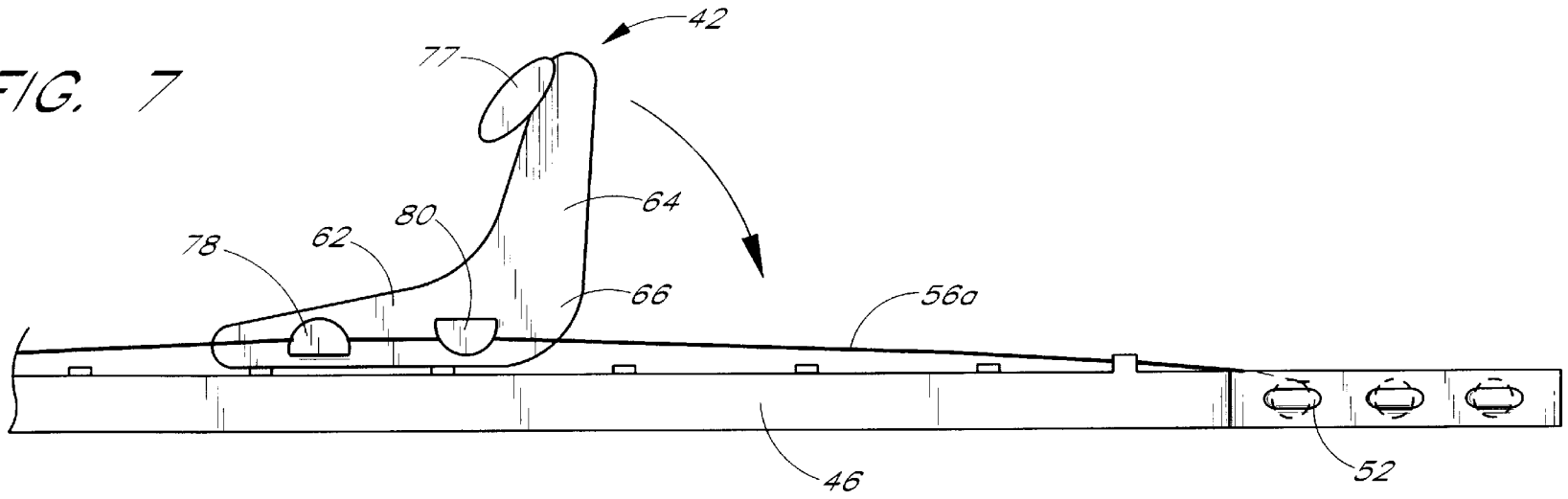
FIG. 7 is a side view of the tuning apparatus in use upon a guitar.

In operation, the tensioning apparatus 42 is positioned on the guitar 40 during tuning of the instrument. The tensioning apparatus is initially positioned so that the bottom surface 74 abuts the neck 46 of the guitar 40 and the second arm 64 points away from or extends upwardly from the neck 46, as best shown in FIG. 7. The user then threads a single string 56*a* through the tensioning apparatus 42 so that the string 56*a* is disposed over the string support surface 90 of the string guide 78 and under the string support surface 90 of the string guide 80 in the manner described above with respect to FIG. 6. Advantageously, the user may thread the string 56*a* through the tensioning apparatus 42 using only a single hand.

Figure 8:
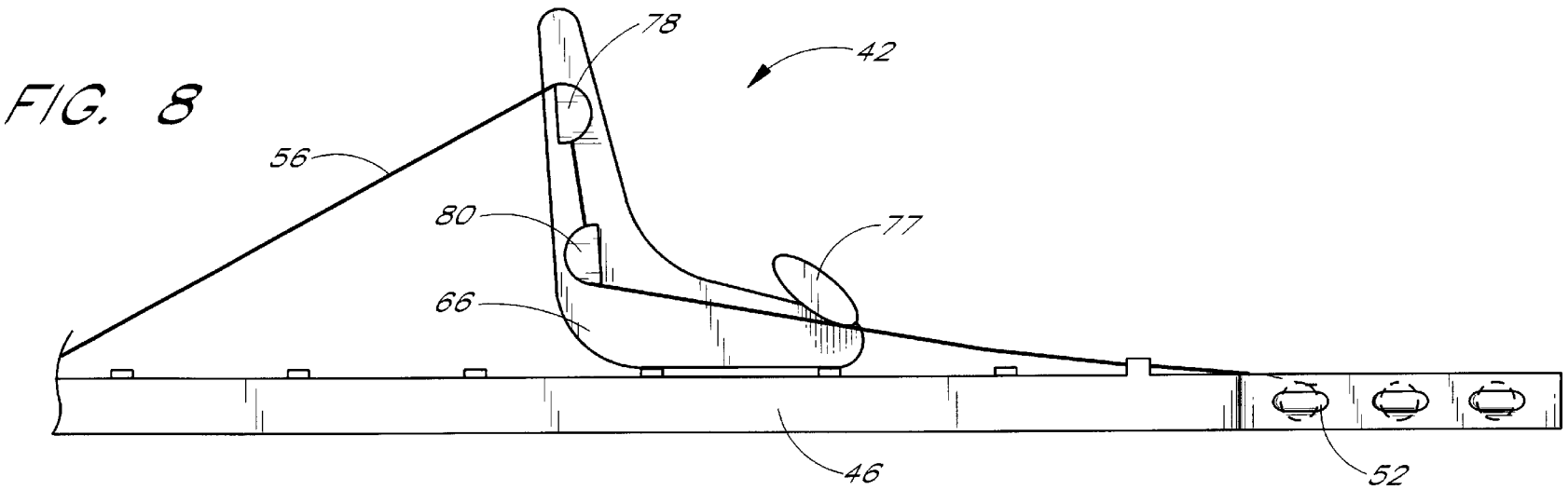
FIG. 8 is a side view of the tuning apparatus in use upon a guitar.

After the tensioning apparatus is placed in the initial position shown in FIG. 7, the user preferably applies a downward force (with respect to the neck 46) on the handle 77 of the tensioning apparatus. The tensioning apparatus 42 thus rotates or pivots about the junction 66, as illustrated by the arrow in FIG. 7. The tensioning apparatus 42 thereby transitions to a second position, as shown in FIG. 8, or to some position midway between the positions shown in FIGS. 7 and 8, depending on the level of slack in the string 56*a*. As the tensioning apparatus 42 moves to the second position, it lifts the string 56*a* relative to the neck 46 and thereby takes up slack in the string 56*a*. The lifting of the string 56*a* results in a tension therein due to the greater path length that the string 56 follows as it threads through the tensioning device 42. The user may thereby apply a desired tension to the string by pushing the second arm 64 toward the neck 46. Only a single hand is required to apply tension via the tensioning apparatus. The user may then use his or her other hand to turn the tuning peg 52 and gradually wrap the string around the tuning peg so that constant tension is present in the string 56 as the user turns the peg 52.

As the string 56 is tightened by turning the tuning peg, any slack present within the string 56 gradually reduces. The user preferably allows the tensioning apparatus 42 to move slowly back toward the position shown in FIG. 7 while the tensioning apparatus 42 pivots about the junction 66 so that the path length of the string 56 gradually reduces. Because the user applies pressure to the handle 77 throughout the winding of the string 56*a* onto the peg 52, any improper variation in the string tension is readily apparent to the user, since any such variation results in increased or decreased force being applied to the user's hand as it presses against the handle 77.

Figure 9:
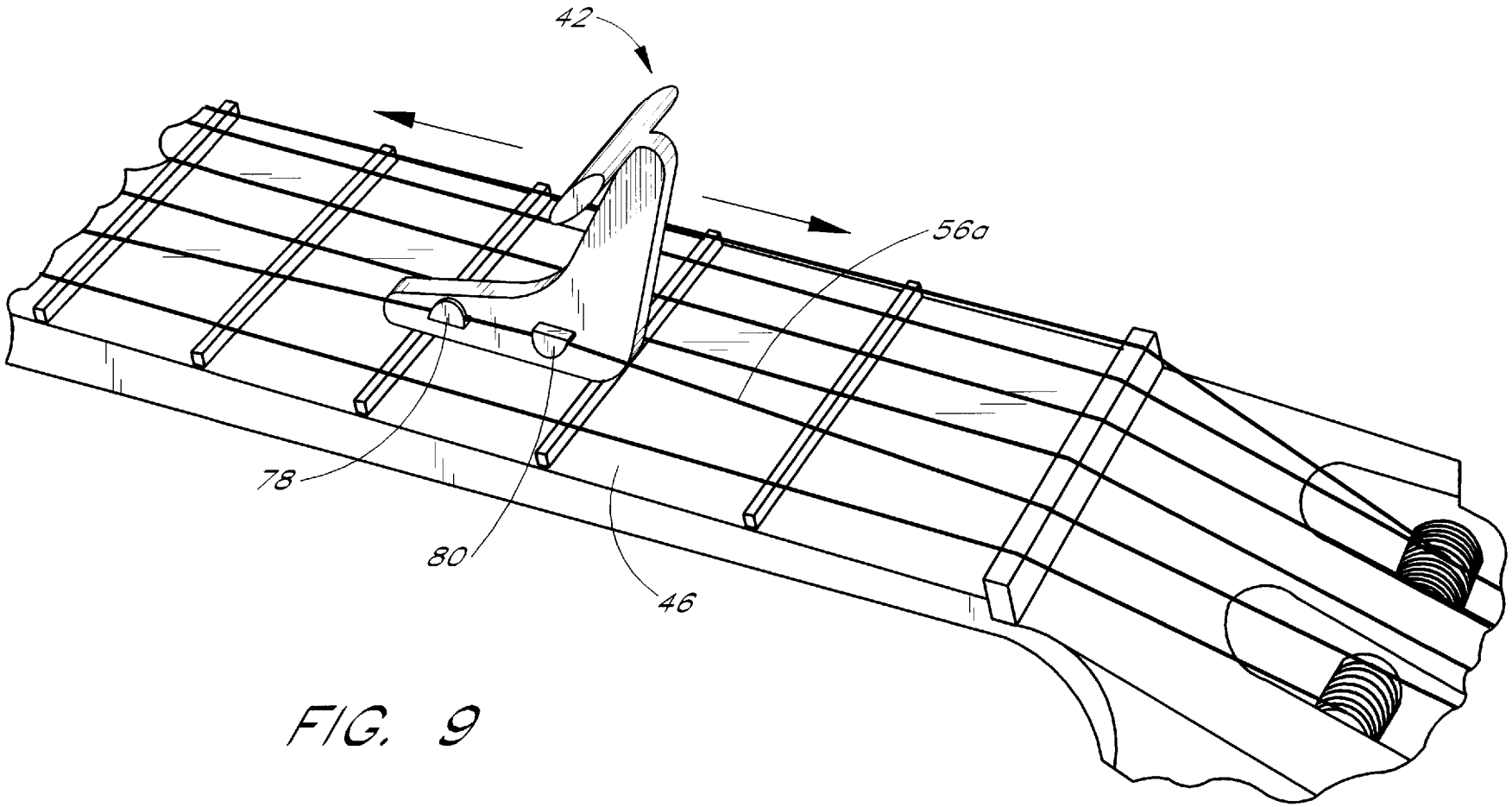
FIG. 9 is a perspective view of the tuning apparatus in use upon a guitar.

With reference to FIG. 9, the tensioning apparatus 42 may also be used to stabilize the tension in the string 56*a* after the string 56*a* has been brought to the an initial tension. The tensioning apparatus 42 is preferably placed in the initial position with a string 56*a* threaded therethrough, as discussed above with respect to FIG. 6. The user then slides the tensioning apparatus 42 back and forth along the length of the neck 46 of the guitar 40, as indicated by the arrows in FIG. 9. The string guides 78, 80 are preferably slid along the entire freely resonating length of the string 56*a*. As the apparatus 42 slides back and forth along the length of the neck 46, the spools 82 of the string guides 78, 80 exert small transverse forces along the string 56*a* at the points of contact with the string guides 78, 80. The forces imposed during this "rolling" of the string 52 between the guides 78, 80 produce small deformations along the length of the string. The forces relax as the string guides move past to thereby produce a cold working effect upon the string 56*a*.

This repeated reversal of small transverse forces upon the string 56 produces the cold working of the string 120. This causes the string to reach its final elasticity more quickly as all plastic deformations are worked out of the string 56 by the rolling. As a result of these plastic deformations, the string will stretch somewhat and require retensioning and retuning in order for it to perform properly. However, because the working can be accomplished quickly and under the control of the user, it becomes possible to initially tune and tension the string, work it with the device, and then immediately retune it so that the stabilized pitch is acquired quickly. In this way, the previously slow process of stretching and retuning which normally accompanies the use of a new string may be avoided, and a string may be played in correct tune quickly.

Although the foregoing description of the preferred embodiment of the invention has shown, described, and pointed out certain novel features of the invention, it will be understood that various omissions, substitutions, and changes in the form of the detail of the apparatus as illustrated as well as the uses thereof, may be made by those skilled in the art without departing from the spirit of the present invention. Consequently, the scope of the present invention should not be limited by the foregoing discussion, which is intended to illustrate rather than limit the scope of the invention.

What is claimed is:

1. An apparatus for tensioning a string of a musical instrument, comprising:

a structure having a first portion comprising a first arm defining a first outer edge and a second portion comprising a second arm defining a second outer edge, wherein the first and second arms meet at an apex so to define a v-shaped structure the first outer edge and the second outer edge defining an angle therebetween;

a first string support on the structure, the first string support configured to support a string of the musical instrument, wherein the first string support is positioned on the first portion a first distance from the first outer edge;

a second string support on the structure, the second string support configured to support the string of the musical instrument, wherein the second string support is positioned on the first portion a second distance from the first outer edge;

wherein the structure is sized to be held in the hand of the user.

2. The apparatus of claim 1, wherein the first distance and the second distance are different so that the string bends along its length when the string is threaded between the first support and the second support.

3. The apparatus of claim 1, additionally comprising a handle on an end of the second arm.

4. The apparatus of claim 1, wherein the first and second string supports comprise spools.

5. An apparatus for tensioning a string of a musical instrument, comprising:

a first arm having a side surface;

a second arm connected to the first arm so that an apex and a v-shaped structure are formed between the second arm and the first arm;

a handle on an end of the second arm distal of the apex;

a first spool on the side surface the first arm, the first spool defining a convex support surface;

a second spool on the side surface the first arm, the second spool defining a convex support surface, wherein the string is threaded between the first spool and the second spool so that the string bends along its length when threaded between the first spool and the second spool.

6. The apparatus of claim 5, wherein the first spool and the second spool are each fixedly mounted to the first arm.

7. The apparatus of claim 5, wherein the first spool and the second spool each have an outer lip that defines a channel sized to receive the string of a musical instrument.

8. The apparatus of claim 5, wherein the first spool is positioned a first distance from the bottom edge of the second arm and the second spool is positioned a second distance from the bottom edge of the second arm, the first distance and the second distance being different.

9. An apparatus for tuning a stringed instrument having a string, comprising:

a handle;

an arm attached to the handle so that the arm and the handle define an apex and a v-shaped structure a pair of spools coupled to the arm, the pair of spools configured to receive the string therebetween when the apparatus is positioned on a neck of the stringed instrument, wherein the spools place the string in tension when the apparatus is positioned on the neck and the handle is moved toward the neck.

10. A method of applying tension to a string of a musical instrument, comprising:

placing a tensioning apparatus against a neck of the musical instrument such that a first arm of the tensioning apparatus is positioned flat against the neck and a second arm of the tensioning apparatus extends upwardly from the neck;

threading the string of the musical instrument through a pair of spools on the first arm of the tensioning apparatus;

pivoting the tensioning apparatus about an apex between the first arm and second arm so that at least a portion of the string is moved away from the neck to reduce slack in the string and apply tension thereto;

tightening the string onto the guitar while applying tension to the string.

11. The apparatus of claim 10, wherein threading the string comprises placing the string between the pair of spools so that the string bends along the length of the string.

12. The apparatus of claim 11, additionally comprising sliding the tensioning apparatus along at least a portion the length of the neck so that the bend in the string travels along at least a portion of the length of the string.

13. The apparatus of claim 10, wherein pivoting the tensioning apparatus comprises moving the first arm of the tensioning apparatus away from the neck and moving the second arm of the tensioning apparatus toward the neck.

* * * * *